United States Patent [19]

Sorrells

[11] 4,112,161

[45] Sep. 5, 1978

[54] TUFTED PILE FABRIC AND METHOD OF MAKING AND INSTALLING THE SAME

[75] Inventor: Samuel Ray Sorrells, Buena Vista, Va.

[73] Assignee: Burlington Industries, Inc., Greensboro, N.C.

[21] Appl. No.: 790,610

[22] Filed: Apr. 25, 1977

[51] Int. Cl.[2] ..... B32B 3/02

[52] U.S. Cl. ..... 428/95; 156/72; 156/252; 156/269; 428/97; 428/131; 428/139

[58] Field of Search ..... 428/95, 17, 97, 131, 428/139; 156/72, 250, 252, 269

[56] References Cited

U.S. PATENT DOCUMENTS

| | | | |
|---|---|---|---|
| 3,157,557 | 11/1964 | Palmer | 428/17 |
| 3,336,178 | 8/1967 | Levitch | 428/95 |
| 3,360,421 | 12/1967 | Sands | 428/95 |
| 3,542,632 | 11/1970 | Eickhoff | 428/95 |

*Primary Examiner*—Marion E. McCamish

*Attorney, Agent, or Firm*—Cushman, Darby & Cushman

[57] ABSTRACT

A tufted pile fabric for use indoors or outdoors as a substantially permanent floor covering. The tufted pile fabric is made entirely from man-made or synthetic materials and includes a synthetic plastic primary backing, and a synthetic plastic secondary backing, laminated together by a hot melt adhesive to form a relatively rigid impervious sheet. The structure is then provided with a plurality of perforations through the substantially impervious sheet comprising the secondary backing, the hot melt adhesive and the primary backing to give the fabric a softer hand and breathability. The tufted pile fabric may then be adhesively secured to a floor structure by a water based adhesive, inert to the primary and secondary backings and hot melt adhesive, with the water evaporating through the perforations to set the adhesive and thereby avoid puckers and edge rippling due to unbonding the pile fabric from the floor structure.

19 Claims, 5 Drawing Figures

Fig. 1.
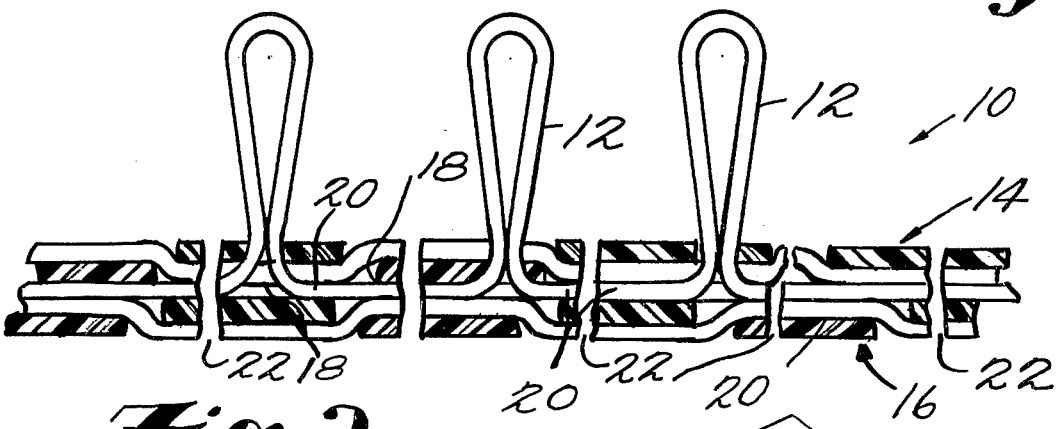
Fig. 2.
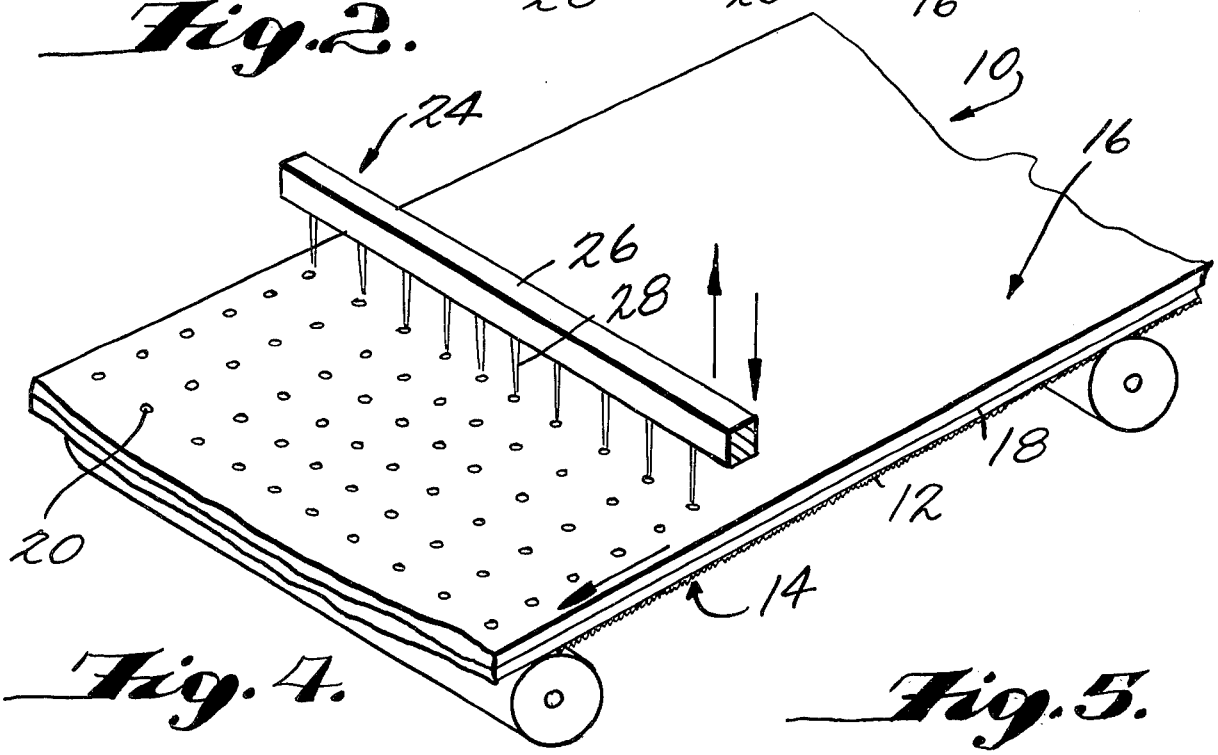
Fig. 4.
Fig. 5.
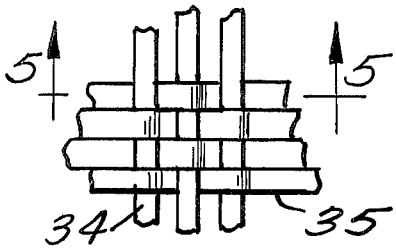
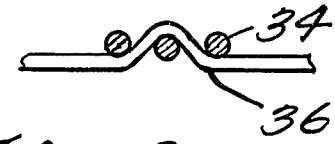
Fig. 3.
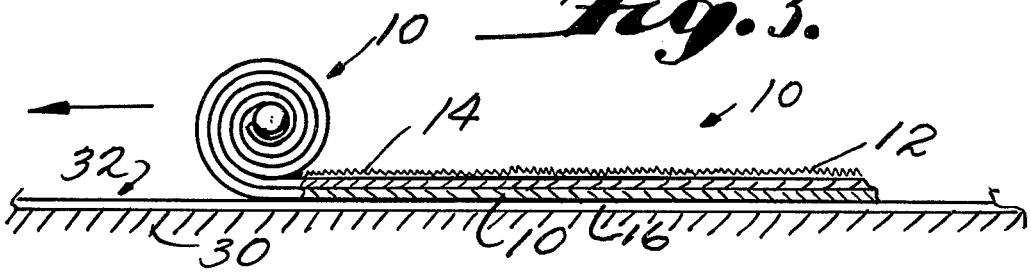

TUFTED PILE FABRIC AND METHOD OF MAKING AND INSTALLING THE SAME

The present invention relates to an improved tufted pile fabric for use indoors or outdoors as a substantially permanent floor covering. Additionally, the present invention relates to an improved method for making a tufted pile fabric and installing the same on a floor structure, as well as to a substantially permanent floor covering.

BACKGROUND OF THE INVENTION

In recent years, tufted pile fabrics utilizing primary and secondary backings made from synthetic plastic materials have been developed for use indoors and outdoors. These carpets have utilized synthetic plastic primary and secondary backings in order to provide stability to the carpet structure and to eliminate the problems encountered previously by carpets which have been made from natural fibers. Carpets made from natural fibers are subject to shrinking and rotting in abnormal weather conditions and when liquids are spilled thereon. Additionally, such carpets are subject to excessive staining and require frequent removal and cleaning.

In U.S. Pat. No. 3,110,905 issued Nov. 19, 1963 to Rhodes and U.S. Pat. No. 3,336,178 issued Aug. 15, 1976 to Levitch, and both assigned to the same assignee as the instant application, namely, Burlington Industries, Inc., there are disclosed tufted pile fabrics utilizing synthetic plastic backings and pile yarn also made from synthetic plastic or man-made fibers. While the tufted pile fabric disclosed in these two patents have been commercially successful for installations wherein the floor covering is subjected to rotting conditions, moisture conditions from rain or spillage of liquids, they have not been completely satisfactory when used in situations wherein the carpeting is to be substantially permanently installed by adhesively securing the same to a floor structure, particularly when the primary and secondary backings are bonded together with a hot melt adhesive. With the advent of the use of hot melt adhesives and the application of such technology to the disclosures in these two patents and particularly to the disclosure in Levitch, the resulting tufted pile fabric provided greatly improved adhesion between the synthetic primary and secondary backings, effectively preventing separation of the primary and the carpet face from the secondary, when the secondary is bonded to a floor structure. Additionally, the hot melt adhesive greatly improves pile bind, effectively preventing removal of carpet tufts from the carpet face by pulling or snagging. However, a carpet with a hot melt bonded primary and secondary backing also exhibits a very firm hand which can make the fabric too stiff for practical installation. More serious however is the fact that the hot melt adhesive combines with the synthetic primary and secondary backings to form a substantially impervious sheet, a factor which has effectively prevented satisfactory water based adhesive installation of such carpets on floor structures because of lack of complete drying and subsequent unbonding or puckering of the undried areas. Water based adhesives are desired for such installations because the adhesive does not dry immediately, thus permitting flexibility and adjustment during carpet installation. Thus, when such carpeting is adhesively bonded to a floor structure by a water based adhesive, it will gradually unbond and display ripples on the edges and pockets or bulges in various places throughout the carpet apparently because the use of the hot melt adhesive for providing the bonding between the primary and secondary backing and for anchoring the tufts to the primary backing, also eliminates the breathability of the carpet to an extent sufficient to prevent adequate drying or setting of the water based adhesive in a practical time following installation.

PRIOR ART

Prior art on this subject is represented by the following patents which disclose various textile fabrics suitable for carpeting as well as means for perforation of sheet material:

| Number | Name | Date |
|---|---|---|
| 2,46,040 | Guild | June 17, 1941 |
| 2,388,069 | Meaker et al | October 30, 1945 |
| 2,515,847 | Winkler | July 18, 1950 |
| 3,137,611 | Krolik, Jr. | June 16, 1964 |
| 3,157,557 | Palmer | November 17, 1964 |
| 3,542,632 | Eickhoff | November 24, 1970 |

In one of the disclosures of the above listed prior art, it will be noted that there is a teaching of a laminated pile fabric structure having perforations therethrough. However, in such disclosure, the carpeting which is made of natural fibers was attached to a laminated backing structure made of layers of loosely matted fibers after the backing structure had been perforated. Such a carpeting did not contemplate the problems involved when using synthetic plastic backings laminated or bonded together by hot melt adhesives which when set provide an impervious relatively rigid sheet therebetween. In another disclosure of the above listed patents, there is a teaching of fibrillating a woven fabric, such as a backing similar to the backings of the aforementioned Rhodes and Levitch patents, the purpose of the fibrillation being to produce a ribbon yarn fabric which is more similar to fabric woven of natural fibers. The fibrillation is provided to the backing prior to forming of the laminated structure so as to provide excellent locking characteristics between the flat ribbon-like warp and filling yarns. Other disclosures of the above listed patents relate to surfacing materials with perforations extending therethrough for the purpose of drainage when such materials are utilized as artificial sods or the like.

BRIEF SUMMARY OF THE INVENTION

In its broadest aspect, the present invention relates to an improvement in a wholly synthetic tufted pile fabric for use as a floor covering either indoors or outdoors. In more detail, the tufted pile fabric includes a synthetic plastic primary backing of substantially uniform thickness having a series of pile projections extending therethrough from one face thereof, a synthetic plastic secondary backing of substantially uniform thickness and means including a hot melt adhesive for securing the secondary backing to the other face of the primary backing and for anchoring the series of pile projections to the primary backing. The hot melt adhesive provides a substantially impervious sheet between and in combination with the primary and secondary backings. A plurality of perforations are provided which extend completely through the secondary backing, the hot melt adhesive, and the primary backing so that the resultant tufted textile fabric will have a softer hand and breathability, making this carpet very suitable for substantially permanent bonding installation on a floor structure by use of a water based adhesive.

Additionally, the present invention contemplates a method of making such a tufted pile fabric having a softer hand, and breathability, and which is capable of being adhesively secured to a floor structure by a water based adhesive. Typically, the method comprises the steps of tufting a series of pile projections through a synthetic plastic primary backing such that they extend through the primary backing and outwardly from the face thereof, and then heating a hot melt adhesive until it is liquefied and tacky and then applying the liquefied hot melt adhesive to the back of the primary backing and substantially immediately pressing a synthetic plastic secondary backing onto the back of the primary backing to form a laminated structure. The hot melt adhesive sets to form a substantially impervious sheet bonding the secondary backing to the primary backing and anchoring the pile projections to the primary backing. This relatively rigid laminated structure is then fairly uniformly pierced from the secondary backing side at a plurality of places thereon to provide a plurality of perforations extending through the secondary backing, the hot melt adhesive and the primary backing, thus giving the resulting structure a substantially softer hand than the unperforated structure, and making the same breathable.

Ancillary to the above, the present invention contemplates providing a substantially permanent floor covering for a floor structure by adhesively securing such perforated tufted pile fabric to the floor structure by a water based installation adhesive, the water of the water based installation adhesive substantially completely and uniformly evaporating through the perforations to cause the installation adhesive to set within a desired time frame following installation, usually overnight. The water based installation adhesive is inert with respect to the synthetic plastic primary and secondary backings, as well as the hot melt adhesive and thus the dimensional stability of the tufted textile fabric is not affected after installation, and yet the bond to the floor structure is strong and substantially permanent.

A further feature of the present invention is to provide a tufted fabric structure which has dimensional stability despite changes in atmospheric conditions and, thus, does not shrink and yet the fabric structure has a relatively soft hand and is breathable, permitting drying of the installation adhesive, whereby it may be substantially permanently installed without subsequent unbonding from the floor structure, resulting in the formation of pockets, bulges, edge rippling and puckering which is believed due to nonuniform drying of the water based adhesive. The breathability provides the necessary porosity to the tufted textile fabric to permit substantially uniform drying and setting of the installation adhesive in a practical short time period following installation.

These and other features, advantages, and objects of the present invention will become more apparent in the more detailed description of the invention which follows and in that description, reference will be made to the accompanying drawings as briefly described below.

BRIEF DESCRIPTION OF THE DRAWINGS

FIG. 1 is an enlarged sectional view of the tufted textile fabric of the present invention taken in the warpwise direction of the fabric.

FIG. 2 is a schematic perspective view illustrating the formation of the perforations from the secondary backing side of the tufted textile fabric shown in FIG. 1.

FIG. 3 discloses schematically the installation of the tufted textile fabric of the present invention on a floor structure.

FIG. 4 is a plan view of a modified form of synthetic plastic woven backing.

FIG. 5 is a sectional view taken on the line 5—5 of FIG. 4.

DETAILED DESCRIPTION OF THE INVENTION

Referring now to the drawings wherein like characters or reference numerals represent like or similar parts, there is disclosed in FIG. 1 a wholly synthetic tufted pile fabric suitable for installation as a floor covering for a substantially permanent installation either indoors or outdoors on a floor structure. In more detail, the tufted pile fabric, which is generally designated at 10, includes a plurality of pile projections 12 which may be either cut or uncut. The pile projections 12 are shown looped rather than cut in FIG. 1 and since the tufted pile fabric 10 is primarily intended for use in situations where the floor covering is substantially permanently installed and would be subjected to fungus and mildew and other conditions which might cause rotting, shrinking and/or staining, the pile projections are made from man-made synthetic plastic fibers, examples of such fibers being made from polyamides such as nylon, polyolefins such as polyethylene and polypropylene, polyesters and copolymers thereof, polymerized acrylic and modacrylic materials, polyvinyl chloride and polyvinylidine chloride and like materials, as well as cellulose acetate and triacetate or the like, or mixtures of such plastic materials. The pile projections are inserted through a primary backing generally designated at 14 by a tufting machine (not shown) as is conventional in the art, which includes a series of oscillating needles arranged to carry the pile yarns from the back of the primary backing 14 through the same and extending from the face. To prevent the undesired pulling out of the pile projections and also to provide a firmer base for the fabric and to give dimensional stability, a secondary backing generally designated at 16 is adhesively secured by the adhesive layer 18 to the primary backing, thus anchoring the pile yarn 12 and the stitch projections 20 thereof as a unitary structure. The provision of the secondary backing for a tufted pile fabric has been common for some time and initially materials such as jute, sponge and foam rubber layers, open mesh scrim and the like have been tried with varying degrees of success along with backsizing materials such as sponge and rubber lattices have been used but these materials frequently deteriorated. More recently, woven synthetic secondary backings such as those disclosed in the aforementioned U.S. Pat. No. 3,336,178 to Levitch have been used, these being made in accordance with the aforementioned U.S. Pat. No. 3,110,905 to Rhodes. Such backings have been found desirable because they are wholly synthetic and of uniform quality and thickness, and enable the making of more uniform carpet constructions having good dimensional stability and good physical properties. For the purpose of this disclosure, the Rhodes U.S. Pat. No. 3,110,905 and the Levitch U.S. Pat. No. 3,336,178 are incorporated herein by reference.

As disclosed in the aforementioned Rhodes patent and Levitch patent, woven backing materials formed of flat ribbon-like strands or yarns made from a synthetic material, typically a polyolefin or one of the other fiber forming materials described above, provide a very satisfactory primary and/or secondary backing which is substantially closely woven and non-foraminous.

In the present invention, in order to securely join the primary and secondary backings together, and to securely lock the tuft stitches in place, and to improve dimensional stability of the tufted pile fabric to make it suitable for use as a substantially permanent floor covering, it is preferred that the secondary backing should be secured to the primary backing by a hot melt adhesive since the hot melt adhesive sets firmly, resists degradation, and substantially permanently combines the secondary backing 16 and the primary backing 14. The sheet of hot melt adhesive 18 also securely anchors the stitches 20 of the pile projections 12. However, such sheet 18 of hot melt adhesive suffers a disadvantage because it is impervious and results in a tufted pile fabric structure having a relatively hard and inflexible hand with no breathability. This hard hand makes the hot melt bonded tufted pile fabric structure difficult to install as a substantially permanent floor covering because of its inflexibility and its lack of porosity, preventing the installation adhesive from setting in a reasonable time. These two factors gradually cause the floor covering to display ripples on the edges and pockets or bulges in various places throughout. The stiffness tends to make the fabric move or rise and unbond from the floor structure in places where the installation adhesive does not dry sufficiently quickly and uniformly. Nevertheless, the hot melt material is desired because it resists deterioration from foreign substances, and provides excellent adhesive qualities as discussed above.

The use of a water based installation adhesive is preferred because of desirable properties. These include low fire danger, being inert to the tufted carpet construction materials, and good drying properties. By the latter is meant that the installation adhesive will dry slowly enough to permit adjustment during installation (in contrast to a "contact" cement), but yet will become set within an hour, e.g. 15–20 minutes, and will dry or cure essentially completely overnight.

To eliminate the aforementioned disadvantages and yet still provide a substantially permanent floor covering having the advantages of dimensional stability and wearability when installed with the further advantage to resist stains, according to the present invention the tufted pile fabric 10 is perforated in a plurality of places from its secondary backing side, the perforations 22 extending through the secondary backing 16, the impervious sheet of hot melt adhesive 18 and the primary backing 14. The perforations may be formed in the tufted pile fabric 10 by use of a tufting machine designated generally at 24 in FIG. 2, the tufting machine being modified to have its needle bar 26 provided with a reduced stroke or with needles 28 of a reduced length so that the needles just penetrate through to the outer surface of primary backing 14 and do not penetrate far enough to interfere with the pile projections 12. Of course, rather than using a modified tufting machine 24, a heavy duty roll provided with a plurality of spikes projecting from its surface may be used so long as the spikes have the correct diameter, length and spacing and so long as a series of hold-down rolls are provided to press the tufted pile fabric 10 down onto the spikes and thus form the perforations 22. It will be appreciated that if a roll type perforation apparatus is used instead of a modified tufting machine 24, the deflection of the roll must be eliminated so that perforations of uniform depth and size are effected across the width of the tufted pile fabric, to provide substantially uniform breathability to the thus perforated fabric.

Referring back to the hot melt adhesive which is utilized to adhesively secure the secondary backing 16 to the primary backing 14 and anchoring the pile projections 12 therein, it has been discovered that very satisfactory results can be obtained by a hot melt adhesive comprising a mixture of three components such as (1) a Picco resin Part 20 made by Hercules, Inc., the resin being an aliphatic aromatic thermoplastic hydrocarbon resin, (2) Elvax pellets Part 55 manufactured by the DuPont Company which is an ethylene-vinyl acetate copolymer and (3) a filler of alumina trihydrate or calcium carbonate. A mixture of 48 percent (14400 pounds) of the alkylated aromatic thermoplastic hydrocarbon resin, 22 percent (6600 pounds) of the ethylene-vinyl acetate copolymer and 30 percent (9000 pounds) of alumna trihydrate were mixed and heated to liquefy the same and then while in a liquefied state, the mixture was applied to either the primary backing or the secondary backing by a doctor blade or the like and the two backings were then pressed together until the hot melt adhesive had set as an impervious sheet of the same.

Once the hot melt adhesive had set to form the laminated structure of the tufted pile fabric 10, the perforations 22 were then made in the same by utilizing needles of the tufting machine 24 which penetrated through the structure just through and to the primary backing 14. The needles were 0.064 inches thick and 0.130 inches wide and the tufted pile fabric was passed through the tufting machine 24 with the secondary backing 16 facing the needles at a rate of 45 feet per minute with the number of strokes of the needle bar being 800 per minute. The width-wise spacing of the needles on the needle board was three-eighths of an inch and the length-wise spacing between the holes formed by the needles 28 was five-eighths of an inch. This perforating procedure is preferred since it fairly accurately controls the size, depth and spacing of the holes so produced, and avoids damage to the pile tufts themselves. This procedure resulted in tufted pile fabric 10 having a sufficiently soft hand to permit ease of installation and the installation was further enhanced as the drying rate of the water based installation adhesive appeared to proceed satisfactorily with evaporation of the water vehicle through the holes provided by the perforations, since this installation did not result in edge ripples or pockets which had plagued adhesive installations of synthetic nonperforated carpets heretofore.

In installing the tufted pile fabric 10 on a floor structure 30 as shown in FIG. 3, a water based adhesive inert to the primary backing 14, secondary backing 16, hot melt adhesive sheet 18 and pile projections 12 was used. In this respect, a preferred installation adhesive is supplied by the Bordon Chemical Company under the tradename PLACCO LA6252, which is believed to be a water based mixture of a synthetic latex and a tackifying resin that is thickened to a trowelable viscosity. Other water based installation adhesives are well known in the art. The water based adhesive 32 is applied to the floor structure 30 by trowels or the like and the tufted pile fabric is then rolled or placed onto the water based adhesive 32 and floor structure 30. The water vehicle of the water based adhesive evaporates through the holes formed by perforations 22, thus, permitting the adhesive to dry out and develop its ultimate strength and tackiness in a reasonable time. The floor structure may be a masonry or concrete floor structure such as found on patios, outside walks or floors, or inside floors of commercial and industrial buildings, as well as in homes, or it may be wood or other suitable subfloor materials where wood or another material is used either inside or outside as a floor structure.

Referring now to FIGS. 4 and 5, there is disclosed a modified synthetic plastic backing material which is preferably used as the secondary backing 16' of the tufted pile fabric 10 although it could be used as a primary backing. In this respect, the woven backing 16' includes synthetic plastic twisted yarns or strands 34 used as the warp and flat ribbon-like yarns or strands 36 used as the weft, the ribbon-like yarns or stands 36 providing the backing material 16 with the characteristics of being substantially impervious or non-foraminous. By utilizing the twisted yarns or strands 34, the resulting backing material 16' has added strength in its warp-wise direction and when this backing material is laminated to the primary backing material 14 of the textile pile fabric 10, the yarns 34 are oriented in a weft-wise direction with respect to the stitches 18 of the pile projections 12 to thus add to the weft-wise dimensional stability of the overall structure.

It is also contemplated that the secondary backing, and even the primary backing, may include spun or multifilament type yarns, particularly in the filling of certain secondary backing constructions, to increase physical adhesion by the hot melt resin or the installation adhesive. In some instances, a synthetic nonwoven material such as DuPont's "Typar" may also be used as the primary backing material.

The perforation size and spacing mentioned above may be changed if desired. An increase in needle bar speed at constant or lower tufted fabric feed will increase the concentration of perforations, while a decrease in needle bar speed or a higher tufted fabric feed will result in a lower concentration of perforations.

As mentioned above, the water based installation adhesive 32 is preferably inert to the materials used in the primary and secondary backings and tufting yarns as well as the hot melt adhesive. It should also be mentioned that the hot melt adhesive likewise is preferably inert to the other materials which make up the tufted pile fabric.

The terminology used throughout the specification is for the purpose of description and not limitation, the scope of the invention being defined in the claims.

What is claimed is:

1. A tufted pile fabric having a dimensional stability, a soft hand and being capable of breathability so it can be permanently secured to a floor structure by a water based adhesive comprising:

a synthetic plastic primary backing of substantially uniform thickness;

a series of synthetic plastic pile projections extending through said primary backing and outwardly from one face thereof;

a synthetic plastic secondary backing of substantially uniform thickness;

means adhesively securing said secondary backing to the other face of said primary backing and anchoring said series of pile projections to said primary backing, said last mentioned means including a hot melt adhesive provided between said primary backing and said secondary backing and defining a substantially impervious and relatively inflexible sheet anchoring the pile projections, primary backing and secondary backing together to provide dimensional stability to the pile fabric; and a plurality of perforations through said pile fabric over its entire surface, each of said perforations extending completely through the secondary backing, impervious relatively inflexible sheet of hot melt adhesive, and the primary backing, said perforations having a size and spacing sufficient to increase flexibility of and cause the impervious sheet to become pervious so as to provide a soft hand for the pile fabric and to provide breathability to the pile fabric while maintaining dimensional stability of the same.

2. A tufted pile fabric as claimed in claim 1 in which the hot melt adhesive includes a mixture of an aliphatic aromatic thermoplastic hydrocarbon resin, ethylene-vinyl acetate copolymer and a filler of alumina trihydrate and/or calcium carbonate.

3. A tufted pile fabric as claimed in claim 2 in which said synthetic plastic primary backing is woven from uniform strands closely spaced together in both warp-wise and weft-wise direction.

4. A tufted pile fabric as claimed in claim 3 in which said synthetic plastic secondary backing is woven strands defining a substantially impervious sheet.

5. A tufted pile fabric as claimed in claim 4 in which some of the strands in one direction are flat strands closely spaced together and wherein strands in another direction are twisted strands.

6. A tufted pile fabric as claimed in claim 1 in which said perforations are in the order of 0.130 inches by 0.064 inches.

7. A tufted pile fabric as claimed in claim 6 in which said perforations are spaced in one direction of the fabric substantially three-eighths of an inch from each other and wherein said perforations are spaced in another direction of the fabric substantially five-eighths of an inch from each other.

8. A method of making a tufted pile fabric having a soft hand capable of being adhesively secured to a floor structure by a water based adhesive comprising the steps of:

tufting a series of synthetic pile projections through a synthetic plastic primary backing and outwardly from one face of the backing;

heating a hot melt adhesive until it is liquefied and tacky;

smoothly applying the liquefied hot melt adhesive to the other face of the primary back backing;

immediately pressing a synthetic plastic secondary backing onto the other face of said primary backing to form a laminated structure and permitting the adhesive to set and form a substantially impervious and relatively inflexible sheet bonding the secondary backing to the primary backing and anchoring the pile projections to the primary backing; and then piercing the laminated structure from the secondary backing side at a plurality of sufficiently close places thereon over the entire surface thereof to provide a plurality of perforations of sufficient size and extending completely through the secondary backing, impervious sheet of hot melt adhesive, and the primary backing, the perforations through the laminated stucture causing the sheet to become pervious and more flexible and causing the pile fabric to have a soft hand while maintaining dimensional stability of the same.

9. A method as claimed in claim 8 including forming the plurality of perforations in spaced rows.

10. A method as claimed in claim 8 including spacing the perforations in one direction of the fabric substantially three-eighths of an inch from each other and in another direction of the fabric substantially five-eighths of an inch from each other.

11. A method as claimed in claim 8 in which said synthetic plastic primary backing and said synthetic plastic secondary backing are each woven from strands and are substantially non-foraminous sheets prior to piercing.

12. A substantially permanent floor covering for a floor structure or the like comprising:

a tufted pile fabric having a dimensional stability, a soft hand and being capable of breathability, said tufted pile fabric including a synthetic plastic primary backing of synthetic plastic substantially uniform thickness, a series of pile projections extending through said primary backing and outwardly from one face thereof, a synthetic plastic secondary backing of substantially uniform thickness, a hot melt adhesive securing said secondary backing to other face of said primary backing and anchoring said series of pile projections to said primary backing, the hot melt adhesive defining a substantially impervious and relatively inflexible sheet providing dimensional stability to said pile fabric, a plurality of perforations, each extending completely through the secondary backing, impervious sheet of hot melt adhesive, and the primary backing, said plurality of perforations having a size and spacing over the pile fabrics entire surface sufficient to increase flexibility of and cause the impervious sheet to become pervious and to provide breathability to the pile fabric while maintaining dimensional stability of the same; and a water based installation adhesive securing the tufted pile fabric to the floor structure, said water based installation adhesive having its water evaporated therefrom through the perforations in the tufted pile fabric.

13. A floor covering as claimed in claim 12 in which said water based installation adhesive is a synthetic latex and tackifying resin.

14. A floor covering as claimed in claim 12 in which said hot melt adhesive includes a mixture of aliphatic aromatic thermoplastic hydrocarbon resin, ethylene-vinyl acetate copolymer and a filler of alumina trihydrate and/or calcium carbonate.

15. A floor covering as claimed in claim 12 in which said perforations in the textile fabric are spaced in one direction of the fabric substantially three-eights of an inch from each other and are spaced in another direction of the fabric substantially five-eights of an inch from each other.

16. A floor covering as claimed in claim 15 in which said perforations are in the order of 0.130 inches by 0.064 inches.

17. A method of making a tufted pile fabric having a dimensional stability, a soft hand and being capable of breathability and then substantially permanently installing the same on a floor structure comprising the steps of:

tufting a series of synthetic plastic pile projections through and outwardly from one side of a synthetic plastic primary backing which is substantially non-foraminous;

heating a hot melt adhesive until it is liquefied and tacky;

smoothly applying the liquefied hot melt adhesive to the other face of the primary backing;

immediately pressing a substantially non-foraminous synthetic plastic secondary backing onto the other face of said primary backing to form a laminated structure and permitting the adhesive to set and form a substantially impervious and relatively inflexible sheet bonding the secondary backing to the primary backing and anchoring the pile projections to the primary backing;

then piercing completely through the laminated structure over its entire surface from the secondary backing side at a plurality of places thereon to provide a plurality of perforations having a size and spaced sufficiently close together and extending through the secondary backing, impervious sheet of hot melt adhesive, and the primary backing to form the tufted pile fabric having a smooth hand, flexibility and breathability;

troweling a viscous water based installation adhesive onto the floor structure; and then applying the tufted pile fabric to the floor structure and permitting the water of the water based installation adhesive to evaporate through the perforations in the tufted pile fabric.

18. A method as claimed in claim 17 in which said water based installation adhesive is a synthetic latex and a tackifying resin and in which said hot melt adhesive includes a mixture of aliphatic aromatic thermoplastic hydrocarbon resin, ethylene-vinyl acetate copolymer and a filler of alumina trihydrate and/or calcium carbonate.

19. A method as claimed in claim 17 in which both said primary backing and said secondary backing are woven.

* * * * *